US006024778A

United States Patent [19]

Shaw

[11] Patent Number: 6,024,778

[45] Date of Patent: Feb. 15, 2000

[54] PRODUCTION OF IRON OR NICKEL-BASED PRODUCTS

[75] Inventor: Lee Hugh Shaw, Oldcotes, United Kingdom

[73] Assignee: Special Melted Products Limited

[21] Appl. No.: 09/010,703

[22] Filed: Jan. 22, 1998

[51] Int. Cl.[7] ..... B22F 9/08

[52] U.S. Cl. ..... 75/338; 420/66; 420/68

[58] Field of Search ..... 75/337, 338, 339; 420/66, 68, 70, 126

[56] References Cited

U.S. PATENT DOCUMENTS

| | | | |
|---|---|---|---|
| 4,331,478 | 5/1982 | Ro et al. | 75/338 |
| 4,942,059 | 7/1990 | Wilson | 427/53.1 |
| 5,102,620 | 4/1992 | Watson et al. | 420/469 |
| 5,332,197 | 7/1994 | Benz et al. | 266/201 |
| 5,352,523 | 10/1994 | Zurecki et al. | 428/408 |
| 5,390,722 | 2/1995 | Ashok et al. | 164/46 |

FOREIGN PATENT DOCUMENTS

| | | | |
|---|---|---|---|
| 0 552 479 A1 | 7/1993 | European Pat. Off. . | |
| 63-100108 | 5/1988 | Japan | 75/338 |
| 63-227703 | 12/1992 | Japan | 75/338 |
| 777775 | 6/1957 | United Kingdom | 75/339 |
| 1 280 815 | 7/1972 | United Kingdom . | |

*Primary Examiner*—George Wyszomierski
*Attorney, Agent, or Firm*—Lahive & Cockfield, LLP

[57] ABSTRACT

A method of producing semi-finished metal iron or nickel-based products by spray forming in which one or more jets of nitrogen or a nitrogen-containing gas are directed onto a stream of molten alloy to atomise the same. A titanium addition is made to the liquid alloy before spray forming occurs. The atomised liquid or partially solidified droplets of alloy collect on a substrate to produce a semi-finished product.

3 Claims, No Drawings

PRODUCTION OF IRON OR NICKEL-BASED PRODUCTS

This invention relates to the production of iron or nickel-based products and more especially to the production of semi-finished such products, eg billets by spray forming.

For the production of special steels and nickel-based super alloys for applications including aero space, nuclear, petrochemical and medical uses, melting routes presently employed are typically vacuum induction melting (VIM) followed by consumable electrode melting (ESR or VAR).

Whilst these multiple melting routes offer significantly enhanced properties compared to conventional ingot solidification processes, for highly alloyed materials, problems of macrosegregation can still be encountered at larger product diameters.

For some highly alloyed materials for critical applications such as aircraft gas turbine engines, the only current way to produce these materials is to add a further melting stage thereby leading to a triple stage melting route. The melting route is then VIM, ESR, VAR with each step being critical to the product quality. The complexity does not stop there, further processing steps are required to achieve properties and structure before the material can be used. These include homogenisation, upset forging, side forging, subsolvus annealing followed by further forging in order to produce satisfactory chemical homogeneity and grain size.

For some materials the tendency to segregation is so great that even multiple melting technology is inadequate, for these powder metallurgy routes must presently be employed. However, the number of process operations and complexity significantly increases and as a consequence so does the cost with very high capital investment required.

Spray forming is a process which involves conversion of liquid metal directly to a homogeneous solid without any intermediate processing steps. The liquid metal to be spray formed is atomised by inert or nitrogen gas in much the same way as for powder production. However, the process parameters are adjusted and the material collected upon a substrate before, on average, full solidification of the particles takes place. In this way a nearly fully dense deposit can be produced. The benefit of this process is a structure which is essentially free from macrosegregation, is of fine and uniform grain size and is potentially, capable of properties equal or superior to products of powder metallurgy.

One disadvantage of spray forming is that significant grain growth and coarsening of the structure can occur during final solidification and cooling of the billet.

One object of the present invention is to provide an improved spray forming process as an alternative technique to powder metallurgy or multiple melting techniques which overcomes or at least alleviates the problems referred to above.

The present invention sets out to overcome, or at least alleviate, this disadvantage.

According to the present invention in one aspect there is provided a method of producing semi-finished iron or nickel-based alloy products by spray forming in which titanium is added to a liquid alloy free of titanium before atomisation with nitrogen or a nitrogen-containing gas, the titanium addition being within the range 0.01 to 2.5% by weight.

In another aspect, the present invention provides semi-finished iron or nickel-based alloy products produced by this method.

Preferably, the titanium addition is within the range 0.1 to 1.5% by weight. The maximum addition may be less than 1.0% by weight.

The base metal of the alloy may be taken from a vacuum induction or similar furnace.

The addition of selected amounts of titanium to an alloy which would not normally contain titanium (e.g. M152 and D2) provides strengthening by solution or intermediate precipitation (gamma prime) effects upon atomisation with nitrogen gas, the gas reacting with the titanium to form titanium nitride which is dispersed as a fine precipitate.

The titanium precipitate acts to prevent or reduce grain boundary movement and thereby resists grain coarsening and recrystallisation which might otherwise occur.

The titanium precipitate can act to improve wear resistance or modify mechanical properties in a way which is normally achieved by grain refinement or may act in this way because it is hard second phase particle similar to a tool steel material.

The spray forming process can take many forms, the common feature being that of directing one or more jets of gas onto a stream of molten metal to atomise the same, and to cause the atomised liquid to partially solidified droplets to collect on a substrate to produce a semi-finished product.

In some processes, the substrate is removed continuously away from the atomisation zone whereby an elongate semi-finished product can be produced. The substrate may be positioned below or to one side of the atomisation zone and the substrate may be moved vertically, horizontally or at a selected angle to the horizontal.

In one exemplary embodiment of this invention, liquid metal of composition (typically by weight 0.1% C, 12% Cr, 1.75% Mo, 2.5% Ni and 0.3% V) with a 1% addition of titanium is poured from an induction melting furnace into a double outlet tundish positioned above a water-cooled spray chamber. As the liquid metal streams enter the spray chamber, they were acted upon by jets of nitrogen gas from a twin atomiser system thereby producing sprays of liquid and partially solidified droplets. Use of a twin atomiser produced enhances structure and deposit yields. These sprays are directed onto the generally vertical face a collector disc which is continuously rotated and withdrawn in a generally horizontal directed by a powered dummy mandrel to produce an elongate spray formed billet typically of between 200 and 500 mm diameter and 2 meters or more in length. A series of rolls are positioned within the spray chamber to support the moving billet.

It will be appreciated that the foregoing is merely exemplary of methods in accordance with the invention and that modifications can readily be made thereto without departing from the true scope of the invention as set out in the appended claims.

I claim:

1. A method of producing a semi-finished iron or nickel-based alloy product by spray forming, comprising the steps of (i) melting an iron or nickel-based titanium-free alloy in a melting furnace to liquefy the same, (ii) adding to the titanium-free alloy a quantity of titanium sufficient to produce in the liquid alloy a titanium content of between 0.01 and 2.5% by weight, (iii) transferring the liquid alloy from the melting furnace to a tundish positioned above a water-cooled spray chamber, (iv) causing a stream of the liquid alloy to flow from an outlet nozzle of the tundish and into the spray chamber, (v) directing jets of nitrogen onto the liquid alloy stream to produce a spray of liquid and partially solidified droplets, (vi) collecting the sprayed droplets on a surface positioned below the spray chamber, and (vii) withdrawing the surface to produce a solidified semi-finished product.

2. The method of claim 1, wherein the titanium addition is within the range 0.1 to 1.5% by weight.

3. The method of claim 1, wherein the titanium addition is within the range 0.1 to 1.0% by weight.

* * * * *